US011136844B2

(12) United States Patent
O'Brien

(10) Patent No.: US 11,136,844 B2
(45) Date of Patent: Oct. 5, 2021

(54) EXPANDED BALL SEAT

(71) Applicant: Robert O'Brien, Katy, TX (US)

(72) Inventor: Robert O'Brien, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/796,133

(22) Filed: Feb. 20, 2020

(65) Prior Publication Data

US 2021/0262301 A1 Aug. 26, 2021

(51) Int. Cl.
*E21B 23/03* (2006.01)
*E21B 34/14* (2006.01)

(52) U.S. Cl.
CPC ..... *E21B 23/03* (2013.01); *E21B 34/14* (2013.01)

(58) Field of Classification Search
CPC ..... E21B 23/03; E21B 34/14
See application file for complete search history.

(56) References Cited

U.S. PATENT DOCUMENTS 9,284,803 B2 * 3/2016 Stone ..... E21B 41/0064
9,574,415 B2 * 2/2017 Xu ..... C22C 32/0005
9,835,003 B2 * 12/2017 Harris ..... E21B 43/26
9,896,901 B2 * 2/2018 Sommers ..... E21B 33/129
2006/0124295 A1 6/2006 Maguire
2006/0196678 A1 9/2006 Connell et al.
2016/0369582 A1 * 12/2016 Bar ..... E21B 43/26
2019/0352998 A1 * 11/2019 Wolf ..... E21B 33/129

FOREIGN PATENT DOCUMENTS

CN 104603393 A 5/2015
WO 2015038119 A1 3/2015
WO 2018148480 A1 8/2018

OTHER PUBLICATIONS

International Search Report and Written Opinion for International Application No. PCT/US2021/018728; International Filing Date Feb. 19, 2021; dated Jun. 9, 2021; 8 Pages.

* cited by examiner

*Primary Examiner* — Matthew R Buck
(74) *Attorney, Agent, or Firm* — Cantor Colburn LLP

(57) ABSTRACT

A method of installing a ball seat in a wellbore, comprising conveying the ball seat via a support member of a tool to a target location in the wellbore; moving an expansion sleeve longitudinally with respect to the tool to expand the ball seat radially to engage the ball seat to a support structure of the wellbore at the target location; and releasing the support member from the engaged ball seat.

12 Claims, 6 Drawing Sheets

EXPANDED BALL SEAT

BACKGROUND

In the resource recovery industry, a ball seat and ball can be used to activate downhole devices. A tool including the ball seat is run into a wellbore to a target location. The ball is then dropped into the wellbore to settle on the ball seat, thereby shifting the ball seat to change a state of the tool. The diameter of the tool restricts the size of the ball that can be dropped as well as the size of various devices that can be operated within the wellbore. Therefore, there is a desired to be able to secure a ball seat to a casing or support structure having a greater diameter than the tool.

SUMMARY

A method of installing a ball seat in a wellbore, comprising conveying the ball seat via a support member of a tool to a target location in the wellbore; moving an expansion sleeve longitudinally with respect to the tool to expand the ball seat radially to engage the ball seat to a support structure of the wellbore at the target location; and releasing the support member from the engaged ball seat.

A tool for installing a ball seat in a wellbore, comprising a support member for securing the ball seat to the tool to convey the ball seat to a target location in the wellbore; a expansion sleeve configured to move longitudinally with respect to the tool in order to expand the ball seat to engage a support structure at the target location.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
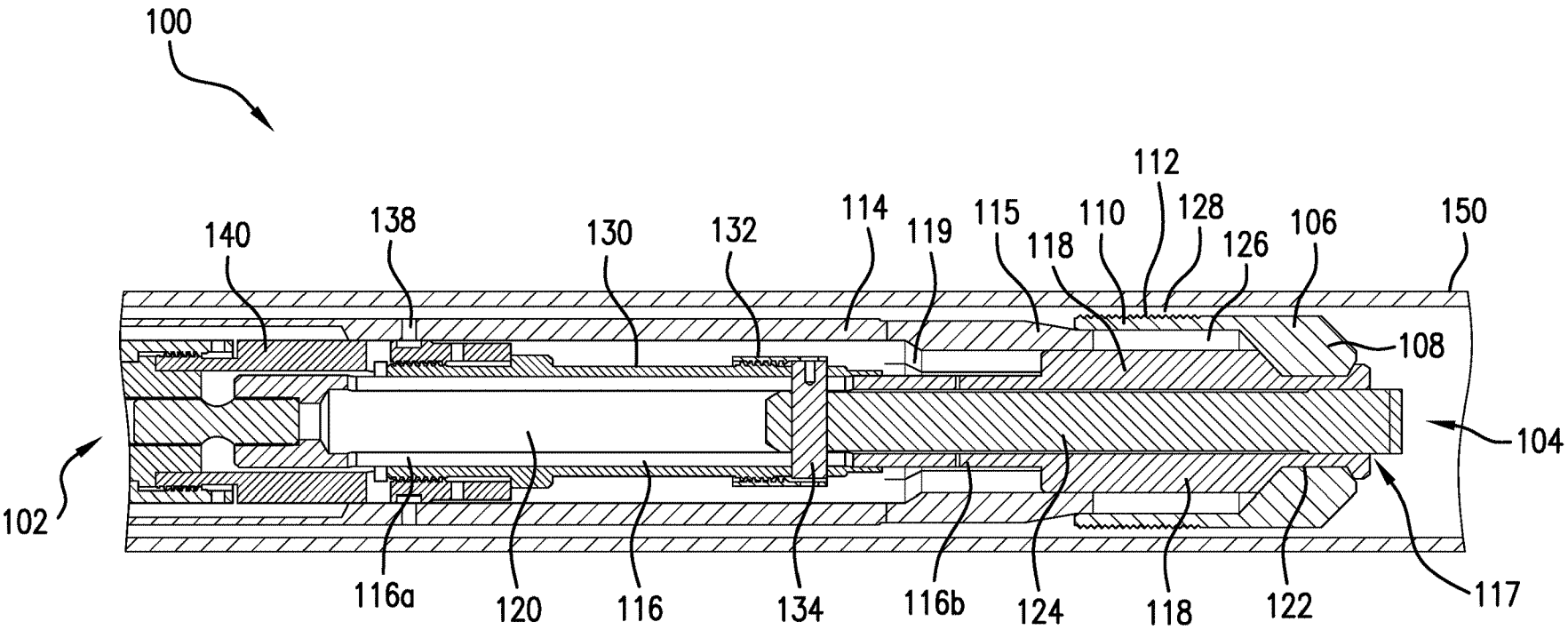
FIG. 1 shows a tool for running a ball seat to a target location in a wellbore.

Referring to FIG. 1, a tool 100 for running a ball seat 106 to a target location in a wellbore is illustrated. The tool 100 extends along a longitudinal axis of the wellbore from a first end 102 to a second end 104. The second end 104 is downhole of the first end 102 when disposed in the wellbore and can be referred to as a bottom end of the tool. The tool 100 includes various components that extend along the longitudinal axis. In general, when referring to these components, a "first end" of the component is an end closest to the first end 102 of the tool and a "second end" of the component is an end closest to the second end 104 of the tool. An element "uphole" of another element is closer to the first end 102 of the tool 100 as the other element, and an element "downhole" of another element is closer to the second end 104 of the tool as the other element.

The first end 102 of the tool 100 can be coupled to run-in equipment at its first end 102 for conveying the tool 100 to the target location from a remote location such as a surface location. A ball seat 106 is attached to the tool 100 at the second end 104 of the tool. The ball seat 106 includes a seat section 108 and a receiving section 110. The receiving section 110 is uphole of the seat section 108 in order to receive a ball dropped into the wellbore and to direct the ball to the seat section 108. The receiving section 110 includes an outer diameter surface that includes a mating section 112 for grasping, engaging or mating to an inner diameter surface of a casing 150 or other support structure in the wellbore.

The tool 100 further includes a support member 116 and a rod 124 for securing the ball seat 106 to the tool 100 in a first configuration and for releasing the ball seat 106 from the tool 100 in a second configuration. The support member 116 is a longitudinally extending component that includes a first section 116*a* and a second section 116*b* downhole of the first section 116*a*. A bore 120 extends through first section 116*a* and the second section 116*b*, forming an opening 117 at its bottom end. The second section 116*b* includes grooves 302 (shown in FIG. 3) extending from the second end to a selected location uphole of the second end. The grooves 302 are circumferentially spaced from each other, thereby forming fingers 118 extending longitudinally. The fingers 118 are capable of flexibly expanding radially outward and/or flexibly collapsing radially inward. Additionally, the fingers 118 include a circumferential recess 122 on their outer diameter surface for receiving the seat section 108 of the ball seat 106. In the first configuration, the rod 124 is disposed in the second section 116*b* of the support member 116, thereby preventing the fingers 118 from collapsing radially inward. In the second configuration, the rod 124 is disposed in the first section 116*a*, thereby allowing the fingers 118 to collapse radially inward in response to an applied force.

Various components associated with the first section 116*a* of the support member 116, such as setting sleeve 130, threaded collar 132, support key 134, are capable of moving the rod 124 between the first section 116*a* and the second section 116*b*.

The first section 116*a* includes at least two longitudinally-extending retraction grooves (not shown). The rod 124 includes a radially extending hole at its first end. The setting sleeve 130 surrounds an exterior of the first section 116*a* of the support member 116 and is capable of sliding along the longitudinal axis of the support member 116. The setting sleeve 130 is coupled to a run-in tool 140 at its uphole end. The setting sleeve 130 includes radially opposed holes. The rod 124 and setting sleeve 130 are rotationally aligned to form a continuous passage through the radially oppose holes of the setting sleeve 130, the retraction grooves and the hole of the rod 124.

A support key 134 extends through the passage formed by the radially opposed holes of the setting sleeve 130, the retraction grooves and the hole of the rod 124, thereby mechanically coupling the rod 124 in the bore 120 to the setting sleeve 130 outside the support member 116. A length of the support key 134 can be selected so that the opposed ends of the support key 134 are flush with the outer diameter of the setting sleeve 130 when the support key 134 is disposed in the passage. A threaded collar 132 is coupled to the setting sleeve 130 to cover the ends of the support key 134, thereby locking the support key 134 and rod 124 to setting sleeve 130.

The support member 116 and rod 124 are shown in FIG. 1 in the first configuration, in which the fingers 118 are prevented from collapsing radially inward due to the presence of the rod 124 in the second section 116*b*. By moving the run-in tool 140 uphole, the setting sleeve 130 moves toward the first end of the tool 100, thereby causing the rod 124 to move from the second section 116*b* of the support member 116 into the first section 116*a*. Moving the run-in tool 140 uphole therefore changes the support member 116 and rod 124 from the first configuration to the second configuration. In the second configuration the fingers 118 are free to collapse radially inward. When desired, the run-in tool 140 the setting sleeve 130 and rod 124 can be moved back toward the second end of the tool 100 to change the support member 116 and rod 124 back to first configuration.

Figure 3:
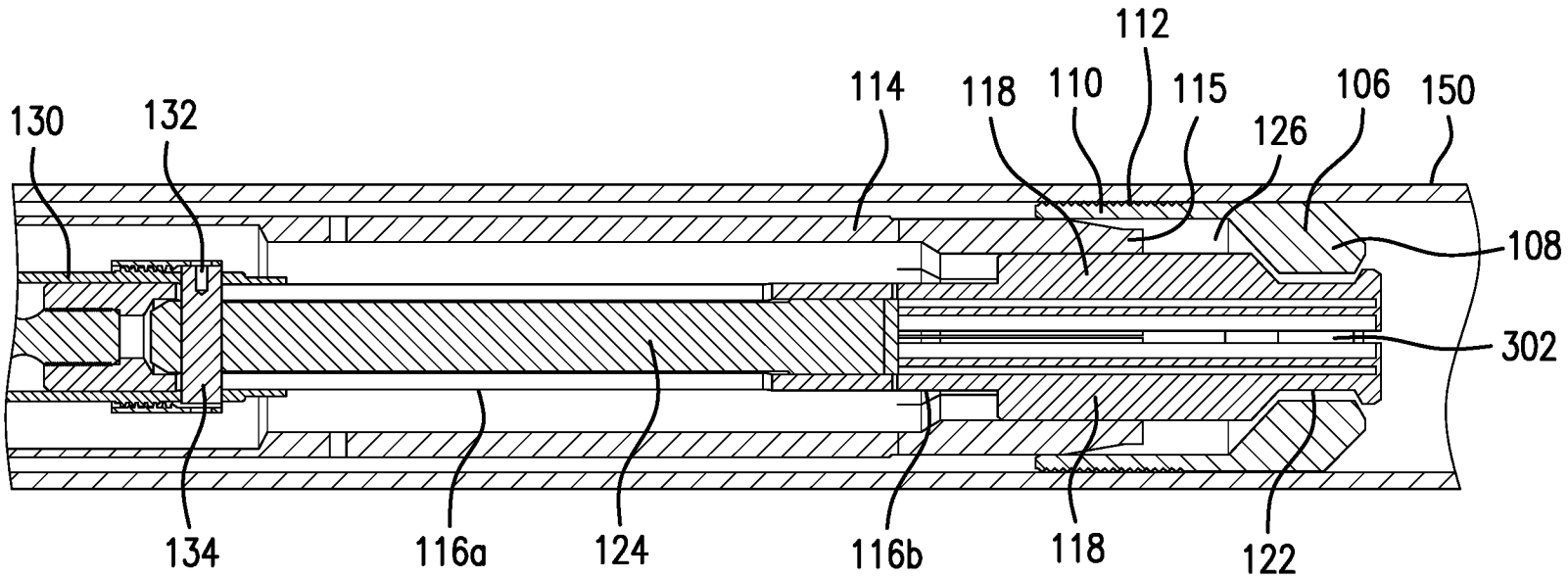
FIG. 3 shows the tool of FIG. 1 during a release operation for setting the ball seat in the wellbore.

The ball seat 106 can be secured to the tool 100 by fitting the seat section 108 of the ball seat 106 into the circumferential recess 122 of the fingers 118, while the support member 116 and rod 124 are in the second configuration. The rod 124 can then be slid axially into the second section 116*b* to expand the fingers 118 radially outward, thereby securing the ball seat 106 to the tool 100. The tool 100 can be run into the wellbore in the first configuration, as shown in FIG. 1. The ball seat 106 is released from the tool 100 by moving the rod 124 away from the fingers 118, as shown in FIG. 3, thereby allowing the fingers 118 to collapse radially inward to release the ball seat 106.

Referring still to FIG. 1, when the ball seat 106 is secured to tool 100, a cavity 126 exists between the outer diameter surface of the fingers 118 and the inner diameter surface of the receiving section 110. When running the tool 100 to the target location, a gap 128 exists between the outer surface of the receiving section 110 and the inner dimeter surface of the casing 150.

The tool 100 further includes an expansion sleeve 114 uphole of the ball seat 106. The expansion sleeve 114 extends from the first end 102 of the tool 100 to the ball seat 106 and provides an exterior housing that shields the support member 116. The expansion sleeve 114 includes a wedge 115 at its downhole end. A collet section 119 between the expansion sleeve 114 and wedge 115 allows radial flexibility of the wedge 115. The expansion sleeve 114 can be locked in place with respect to the tool 100 via a release member 138. The release member 138 connects the expansion sleeve 114 to the run-in tool 140. Once the tool 100 is at its target location, a force can be applied to the expansion sleeve 114 to move the expansion sleeve 114 axially, therefore breaking the release member 138 and allowing the expansion sleeve 114 to move axially. Moving the expansion sleeve 114 toward the second end 104 of the tool drives the wedge 115 into the cavity 126, thereby expanding the ball seat 106 radially outward to mate or engages with the casing 150, as discussed with respect to FIGS. 2 and 3.

Figure 2:
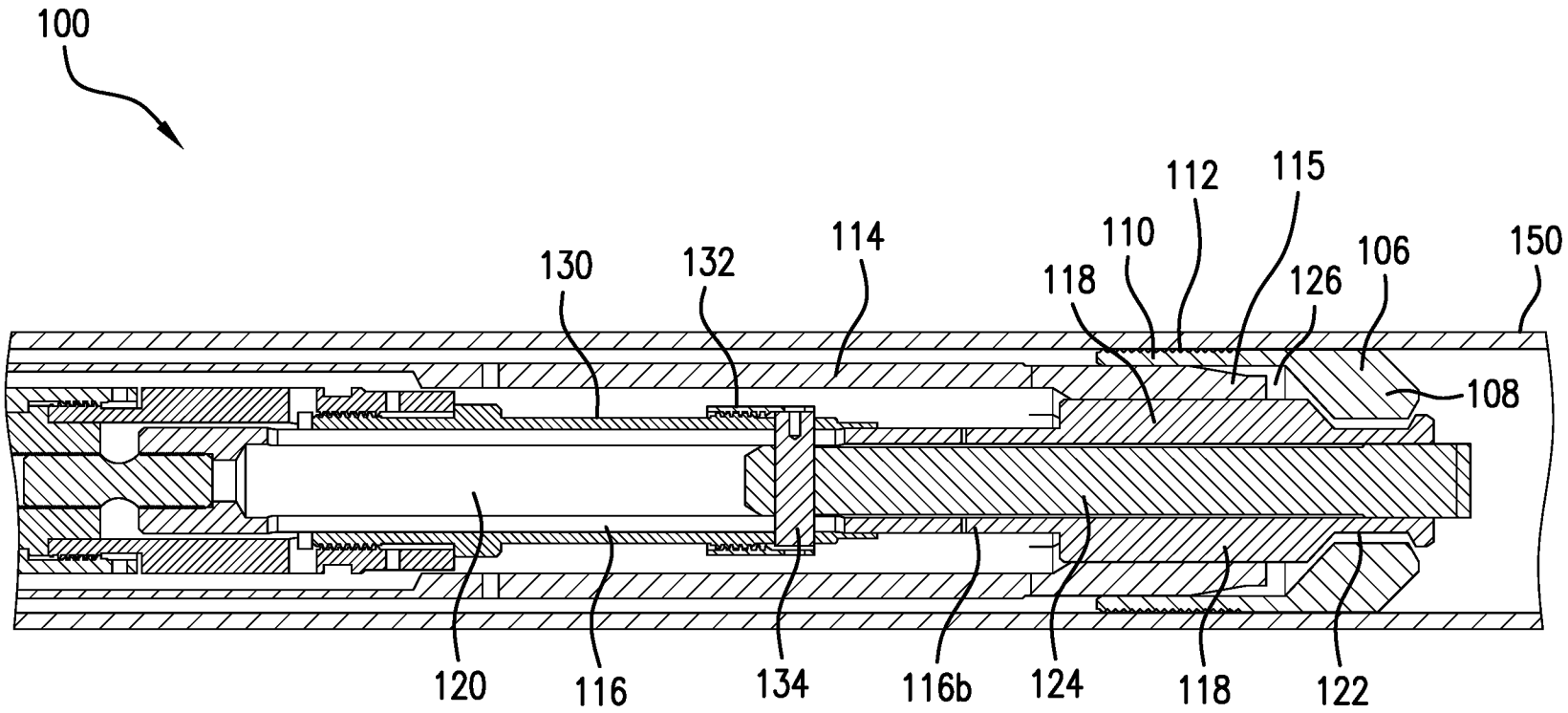
FIG. 2 shows the tool of FIG. 1 during a setting operation for setting the ball seat in the wellbore.

FIG. 2 shows the tool 100 of FIG. 1 during a setting operation for setting the ball seat 106 in the wellbore. The expansion sleeve 114 is moved toward the second end of the tool 100. As a result, the wedge 115 is forced into the cavity 126. Since the rod 124 is in the second section 116*b*, moving the wedge 115 into the cavity 126 causes the receiving section 110 to expand radially outward against the casing 150. The mating section 112 therefore grips or mates to the inner diameter surface of the casing 150, engaging or securing the ball seat 106 to the casing 150 at the target location.

FIG. 3 shows the tool 100 of FIG. 1 during a release operation for setting the ball seat 106 in the wellbore. With the expansion sleeve 114 in its axially downhole location, the rod 124 is moved from the second section 116*b* to the first section 116*a*, by moving the run-in tool 140, setting sleeve 130 and support key 134 uphole. The fingers 118 are now capable of collapsing radially inward. By pulling the support member 116 uphole, the fingers 118 collapse radially inward, allowing the circumferential recess 122 of the fingers 118 to release the seat section 108 of the ball seat 106.

Figure 4:
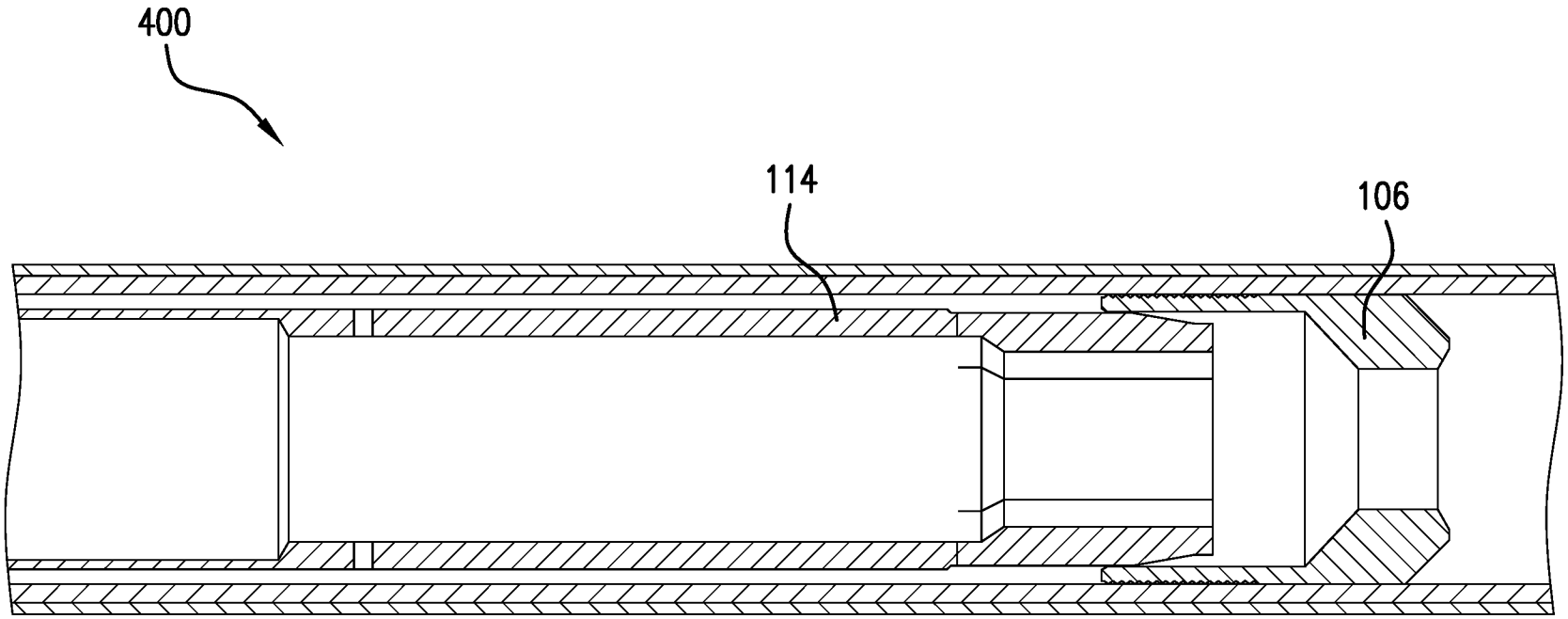
FIG. 4 shows a possible final configuration of the ball seat in the wellbore.

FIG. 4 shows a possible final configuration 400 of the ball seat 106 in the wellbore. The support member 116, rod 124 and other run-in equipment have been removed from the wellbore, leaving only the ball seat 106 and the expansion sleeve 114. Subsequently wellbore operations can be performed by dropping a ball through the expansion sleeve 114 to land at the ball seat 106.

Figure 5:
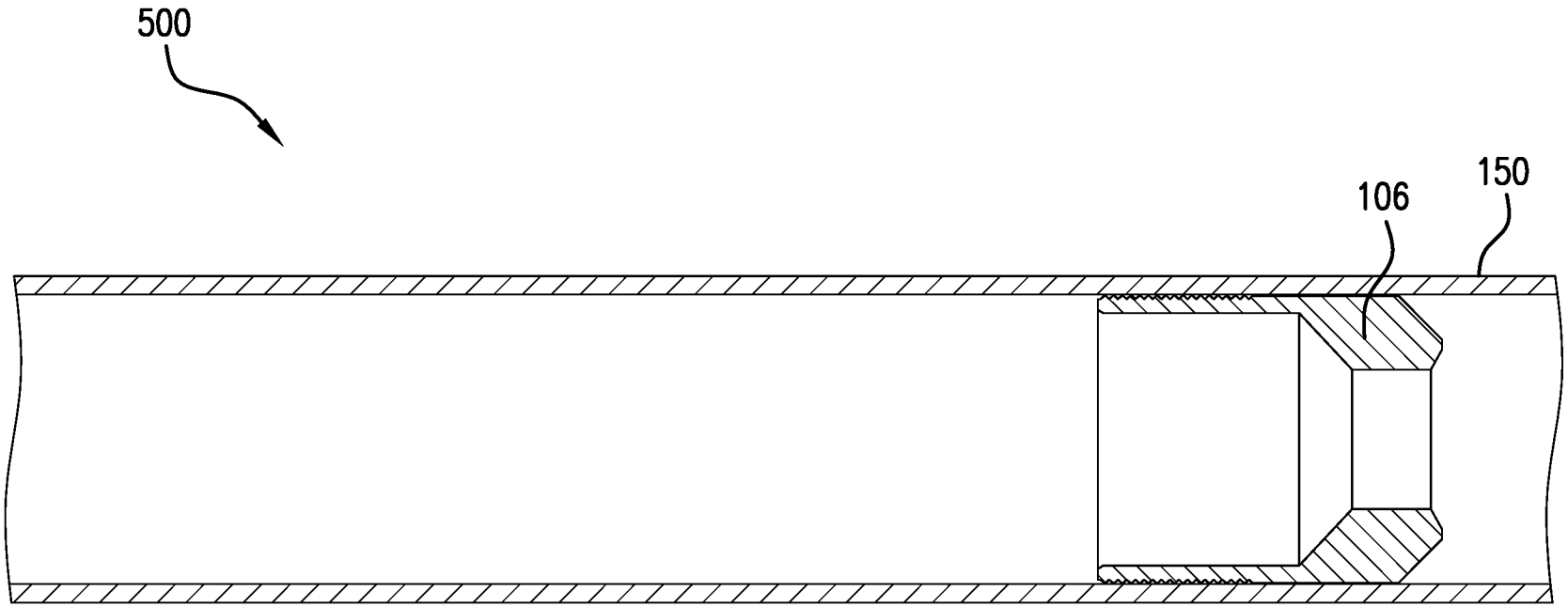
FIG. 5 shows another possible final configuration of the ball seat in the wellbore.

FIG. 5 shows another possible final configuration 500 of the ball seat 106 in the wellbore. In addition to the support member 116, rod 124 and other run-in equipment, the expansion sleeve 114 has been remove to a remote location. Subsequently wellbore operations can be performed by dropping a ball through the casing 150 to land at the ball seat 106.

Figure 6:
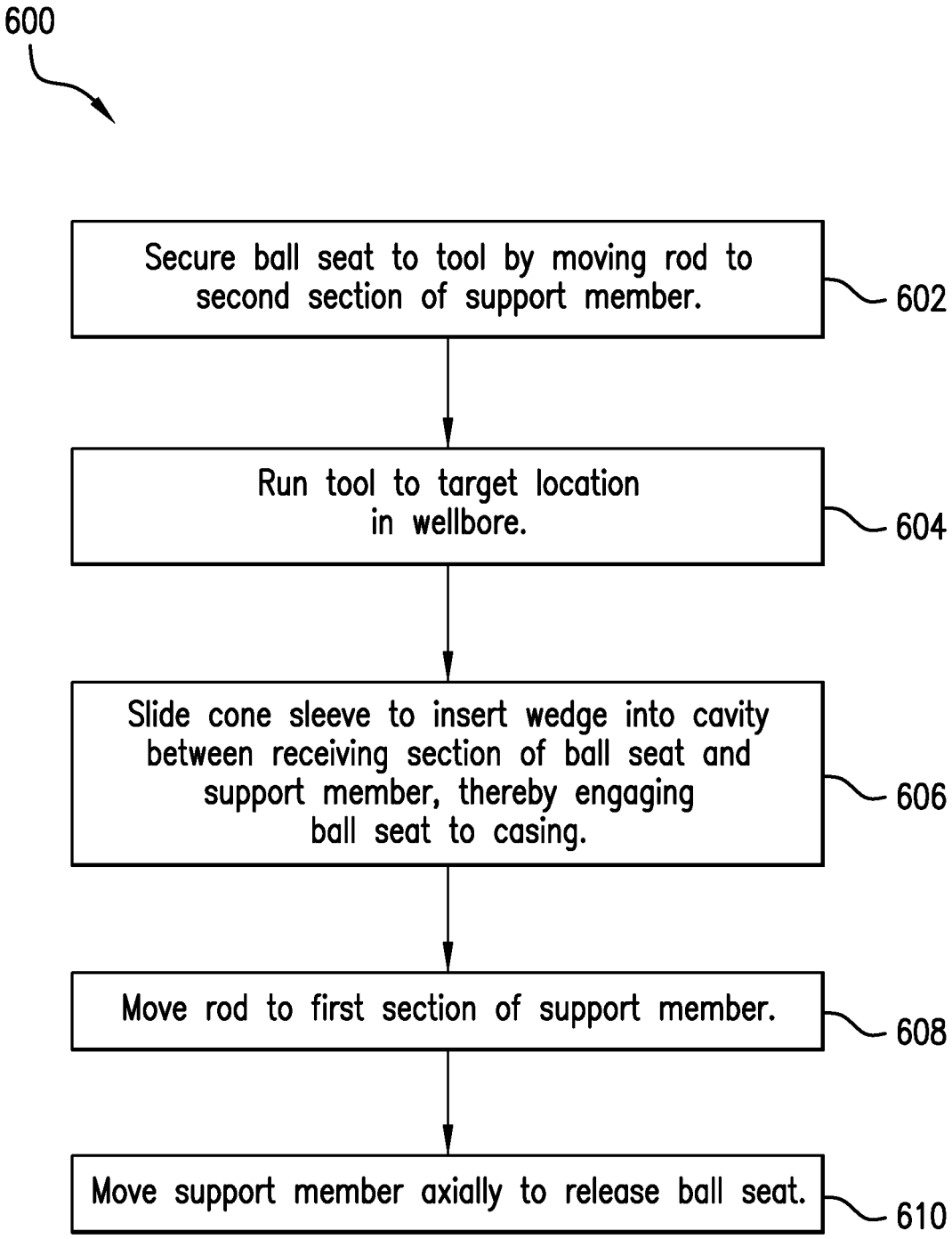
FIG. 6 shows a flowchart illustrating a method for installing a ball seat in a wellbore.

FIG. 6 shows a flowchart 600 illustrating a method of installing a ball seat in a wellbore. In box 602, the ball seat is secured to the tool by placing the seat section of the ball seat in the recess of the second section of the support member and moving the rod into the bore of the second section. In box 604, the tool is run downhole to the target location. In box 606, the expansion sleeve is slide along the tool to move the wedge into the cavity between the receiving section of the ball seat and the support member to expand the ball seat radially into the casing. In 608, the rod is move into the first section of the support member. In box 610, the support member is moved axially, allowing the fingers of the second section to flex radially inward in order to release the ball seat.

Set forth below are some embodiments of the foregoing disclosure:

Embodiment 1: A method of installing a ball seat in a wellbore, including conveying the ball seat via a support member of a tool to a target location in the wellbore; moving a expansion sleeve longitudinally with respect to the tool to expand the ball seat radially to engage the ball seat to a support structure of the wellbore at the target location; and releasing the support member from the engaged ball seat.

Embodiment 2: The method of any prior embodiment further including holding the expansion sleeve stationary with respect to the tool via a release member while the ball seat is conveyed to the target location and rupturing the release member by applying a longitudinal force to the expansion sleeve.

Embodiment 3: The method of any prior embodiment, wherein the ball seat includes a seat section and a receiving section, further including securing the seat section to the support member so that an inner diameter of the receiving section and an outer diameter of the support member define a cavity.

Embodiment 4: The method of any prior embodiment, wherein moving the expansion sleeve moves a wedge of the expansion sleeve into the cavity to expand the cavity.

Embodiment 5: The method of any prior embodiment, wherein the support member includes a first section and a second section including fingers, the ball seat securable the second section, further including placing a rod in the second section to prevent the fingers from collapsing radially inward.

Embodiment 6: The method of any prior embodiment, further including moving the rod from the second section to the first section to allow the fingers of the second section to collapse radially inward to release the ball seat.

Embodiment 7: The method of any prior embodiment, further including moving the rod from the second section to the first section via a bore in the support member by retracting a setting sleeve.

Embodiment 8: The method of any prior embodiment, further including removing the expansion sleeve from the target location to leave the engaged ball seat at the target location.

Embodiment 9: A tool for installing a ball seat in a wellbore, including a support member for securing the ball seat to the tool to convey the ball seat to a target location in the wellbore; an expansion sleeve configured to move longitudinally with respect to the tool in order to expand the ball seat to engage a support structure at the target location.

Embodiment 10: The tool of any prior embodiment, further including a release member configured to hold the expansion sleeve stationary with respect to the tool while the ball seat is conveyed to the target location.

Embodiment 11: The tool of any prior embodiment, wherein the ball seat includes a seat section and a receiving section, an inner diameter of the receiving section and an outer diameter of the support member defining a cavity when the seat section is secured to the support member.

Embodiment 12: The tool of any prior embodiment, wherein the expansion sleeve further comprises a wedge configured to move into the cavity to expand the ball seat.

Embodiment 13: The tool of any prior embodiment, wherein the support member comprises a first section and a second section, the second section having fingers, further including a rod disposable in the second section to prevents the fingers from collapsing radially inward.

Embodiment 14: The tool of any prior embodiment, wherein the rod is movable to the first section of the support member to allow the fingers to collapse radially inward, thereby releasing the ball seat from the tool.

Embodiment 15: The tool of any prior embodiment, wherein the expansion sleeve is removable from the target location to leave the engaged ball seat at the target location The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of installing a ball seat in a wellbore, comprising:

conveying the ball seat via a support member of a tool to a target location in the wellbore, the support member including a first section, a second section having fingers and a bore through the first section and the second section, a rod movable in the bore between the first section and the second section, wherein the rod prevents the fingers from collapsing radially inward when in the second section, a setting sleeve surrounding an exterior of the first section and slidable along the support member, and a support key that couples the rod to the setting sleeve through the support member;

moving an expansion sleeve longitudinally with respect to the tool to expand the ball seat radially to engage the ball seat to a casing of the wellbore at the target location; and moving the setting sleeve along the support member to move the rod within the bore from the second section to the first section, thereby releasing the support member from the engaged ball seat.

2. The method of claim 1, further comprising holding the expansion sleeve stationary with respect to the tool via a release member while the ball seat is conveyed to the target location and rupturing the release member by applying a longitudinal force to the expansion sleeve.

3. The method of claim 1, wherein the ball seat includes a seat section and a receiving section, further comprising securing the seat section to the support member so that an inner diameter of the receiving section and an outer diameter of the support member define a cavity.

4. The method of claim 3, wherein moving the expansion sleeve moves a wedge of the expansion sleeve into the cavity to expand the cavity.

5. The method of claim 1, wherein moving the rod from the second section to the first section allows the fingers of the second section to collapse radially inward to release the ball seat.

6. The method of claim 1, further comprising removing the expansion sleeve from the target location to leave the engaged ball seat at the target location.

7. A tool for installing a ball seat in a wellbore, comprising:

a support member for securing the ball seat to the tool to convey the ball seat to a target location in the wellbore, the support member including a first section, a second section having fingers and a bore through the first section and the second section;

a rod movable in the bore between the first section and the second section, wherein the rod prevents the fingers from collapsing radially inward when in the second section;

a setting sleeve surrounding an exterior of the first section and slidable along the support member;

a support key that couples the rod to the setting sleeve through the support member to allow the setting sleeve to move the rod within the bore; and an expansion sleeve configured to move longitudinally with respect to the tool in order to expand the ball seat to engage a support structure at the target location.

8. The tool of claim 7, further comprising a release member configured to hold the expansion sleeve stationary with respect to the tool while the ball seat is conveyed to the target location.

9. The tool of claim 7, wherein the ball seat includes a seat section and a receiving section, an inner diameter of the receiving section and an outer diameter of the support member defining a cavity when the seat section is secured to the support member.

10. The tool of claim 9, wherein the expansion sleeve further comprises a wedge configured to move into the cavity to expand the ball seat.

11. The tool of claim 7, wherein the rod is movable to the first section of the support member to allow the fingers to collapse radially inward to release the ball seat from the tool.

12. The tool of claim 7, wherein the expansion sleeve is removable from the target location to leave the engaged ball seat at the target location.

* * * * *